US005801131A

United States Patent [19]

Coffey et al.

[11] Patent Number: 5,801,131

[45] Date of Patent: *Sep. 1, 1998

[54] LUBRICANT COMPOSITION FOR MUSICAL INSTRUMENTS

[75] Inventors: B. Howard Coffey, LaGrange; Gary L. Coffey, Glendale, both of Ky.

[73] Assignee: Coffey Marketing Corporation, Louisville, Ky.

[ * ] Notice: The term of this patent shall not extend beyond the expiration date of Pat. No. 5,691,285.

[21] Appl. No.: 681,306

[22] Filed: Jul. 22, 1996

Related U.S. Application Data

[63] Continuation-in-part of Ser. No. 536,994, Sep. 29, 1995, abandoned.

[51] Int. Cl.[6] ..... C10M 127/00

[52] U.S. Cl. ..... 508/491; 508/583

[58] Field of Search ..... 508/491, 583; 585/1

[56] References Cited

U.S. PATENT DOCUMENTS

| | | | |
|---|---|---|---|
| Re. 29,649 | 5/1978 | Farnsworth | 252/171 |
| 2,205,183 | 6/1940 | Woodhouse | 508/491 |
| 2,491,774 | 12/1949 | Schulz | 508/491 |
| 4,670,174 | 6/1987 | Mirkin | 508/491 |

*Primary Examiner*—Prince Willis, Jr.
*Assistant Examiner*—Cephia D. Toomer
*Attorney, Agent, or Firm*—David W. Carrithers

[57] ABSTRACT

The application of a nontoxic and biodegradable musical lubricant and/or cleaning composition to the moving parts of musical instruments used for reducing the friction between the contact surfaces of valve, slide and key elements of musical instruments. The musical instrument lubricant composition is especially useful for application to the parts of the musical instruments which may come into contact with the human body. The nontoxic musical instrument lubricant composition includes a nontoxic oil base such as vegetable oil, preferably corn oil or olive oil, and a nontoxic solvent such as ethanol, preferably ethyl alcohol, and/or a citrus solvent, such as a terpene compound, preferably limonene. The preferred embodiment also includes a terpene, preferably limonene, to provide a nontoxic flavoring and/or scenting agent to provide good wetting and film forming properties and a pleasant naturally occurring organoleptic fragrance and scent.

10 Claims, No Drawings

LUBRICANT COMPOSITION FOR MUSICAL INSTRUMENTS

This application is a Continuation-In-Part of U.S. patent application Ser. No. 08/536,994 filed on Sep. 29, 1995, now abandoned.

FIELD OF THE INVENTION

The present invention relates to the application of a nontoxic, biodegradable lubricating and cleaning composition for lubrication the moving parts of musical instruments such as valves, slides, and/or keys.

BACKGROUND OF THE INVENTION

It has been the prior practice to use petroleum based lubricants such as glycols, "VASELINE™", petroleum distillates, or the like, or to use silicone materials applied to the valve, slide or keys of musical instruments. While such materials have generally been used as lubricants they have not been entirely satisfactory in connection with lubrication of the moving parts of musical instruments. These lubricants are nondigestable and often form undesirable residue buildup requiring constant cleaning of the instrument. These conventional lubricants often harden relatively quickly if the instrument is not used frequently and requires intensive cleaning efforts for proper maintenance. These grease or silicone preparations often create grease lumps which prevents correct movement of the valves, slide, or keys. Moreover, unlike the present invention, these conventional lubricants tend to stain cloth and cause oxidation of the metallic surfaces of the instruments forming discoloration thereof and contamination of the garments of the musician. Furthermore, lubricity is maintained only over a relative short time so that the lubricating film has to be frequently renewed. Further, conventional lubricants are not ingestible. This presents a problem when the lubricant is accidently ingested and/or vapors or gases associated with the conventional lubricants are inhaled during playing of the instrument. Furthermore, some of these conventional lubricants emit an unpleasant and undesirable odor objectionable to the user.

SUMMARY OF THE INVENTION

The present invention relates to the application of a nontoxic and biodegradable musical instrument lubricating and cleaning composition for use to remove residue and form a lubrication film to reduce the friction between the contact surfaces of musical instruments which come into contact with the user. The musical instrument lubricant composition is especially useful for application to the valves, slide, and key elements of the musical instrument. The nontoxic musical instrument lubricant composition includes a nontoxic oil base such as vegetable oil, preferably corn oil or olive oil, and a nontoxic solvent such as ethanol, preferably ethyl alcohol, and/or a citrus solvent, such as a terpene compound, preferably limonene. The preferred embodiment also includes limonene as a nontoxic flavoring and/or scenting agent to provide good wetting and film forming properties and a pleasant naturally occurring organoleptic fragrance and scent.

The lubricant composition of the present invention includes a nontoxic oil base such as vegetable oil, preferably corn oil or olive oil, and a nontoxic solvent such as ethanol, preferably ethyl alcohol, and/or a citrus solvent such as a terpene compound preferably limonene. The preferred embodiment includes a terpene compound preferably limonene as a nontoxic citrus solvent which has flavoring and scenting properties which may be use with the vegetable oil or in combination with the ethanol. Limonene provides a pleasant naturally occurring organoleptic scent which is useful to provide a clean scent to the user; furthermore, limonene has good wetting properties and film forming properties.

Moreover, the lubricant composition of the present invention may be used as a nontoxic and/or scented lubricant for application to other mechanical components of athletic equipment or to reduce the friction of the valves, slides, or keys or other parts which are in intimate contact with the user. The biodegradable nontoxic lubricant composition of the present lasts longer than conventional lubricant compositions, does not accumulate and cause build-ups as does petroleum based lubricants, is easy to remove with readily available detergents.

DETAILED DESCRIPTION OF THE PREFERRED EMBODIMENT

Lubricant compositions within the scope of the present invention can be compounded to include only materials which can be safely ingested so that the compositions are safe for storage and use. The lubricant compositions are particularly important for applications where petroleum based materials are replaced periodically. Biodegradable nontoxic lubricants are also important where there is a likelihood of ingestion or absorption by humans over a sustained period of time. For instance, a lubricant used with musical instruments may be transferred to the hands and/or mouth of the musician. Moreover, the scent of the lubricant is an important consideration due to the proximity of the instruments to the face.

The lubricating and cleaning composition of the present invention includes a nontoxic natural vegetable oil base, preferably corn oil or olive oil; a nontoxic ingestible solvent, preferably ethyl alcohol, ("ethanol"); and a citrus solvent such as terpene, preferably limonene. The lubricant compositions within the scope of the present invention comprise a range of from about 0.1 percent to 10.0 percent of an ingestible vegetable oil such as corn oil, olive oil, coconut oil, peanut oil, or other readily available natural vegetable oils. The balance of the lubricant composition, as much as 99.9 percent is an nontoxic ingestible solvent for controlling the viscosity of the lubricant such as an alcohol, preferably ethanol or ethyl alcohol. It is possible to provide a lubricant composition using vegetable oil and the citrus solvent, without the alcohol; however, the resulting solution is inferior in cleaning properties, expensive, and has a very strong odor. The preferred composition includes up to 50% of a citrus solvent such as a terpene compound preferably limonene; however, at concentrations above 25% the smell of the limonene is very noticeable. The more preferred embodiment comprises from 0.1 to 10 percent vegetable oil in combination with about 75 to about 99 percent ethyl alcohol and about 0.1 to about 25 percent limonene as a citric solvent which is also a nontoxic flavoring and/or scenting agent. Limonene provides a pleasant naturally occurring organoleptic scent which is useful in hunting applications to aid in masking the scent of the hunter.

The lubricant composition of the present invention comprises from about 0.1 to about 10.0 percent vegetable oil and about 75 to about 99 percent solvent, wherein the solvent is a nontoxic solvent such as an alcohol such as ethanol, and/or a citrus solvent such as limonene. Since limonene is a citrus solvent, it is possible to utilize limonene as a substitution for the alcohol; however, the smell is too strong to be of practical use and limonene is a relatively expensive ingredient as compared to vegetable oil and/or alcohol. More preferably, the lubricant composition of the present invention comprises from about 0.1 to about 5.0 percent vegetable oil and from about 75.0 to about 99.0 percent solvent, wherein the solvent is a nontoxic solvent such as an alcohol such as ethanol, and from about 0.1 to about 10.0 percent of a citrus solvent such as limonene. More preferably, the lubricant composition of the present invention comprises from about 1.0 to about 2.0 percent vegetable oil and about 90.0 to about 99.0 percent solvent, wherein the solvent is a combination of about 90 to about 99 percent of an alcohol such as ethanol and about 1 to 10 percent of a citrus solvent such as limonene. In the preferred embodiment, the lubricant composition of the present invention comprises about 1.0 percent vegetable oil such as corn oil, about 94.0 percent of an alcohol such as ethanol, and about 5.0 percent of a citrus solvent such as limonene. Thus, the preferred embodiment utilizes a proportions of the citrus solvent and alcohol solvent.

The alcohol provides a superior viscosity control agent as compared to the citrus solvents; however, the alcohol and vegetable oil combination have a peculiar odor, such as associated with hospitals, which ore may find undesirable. Moreover, the lubricant composition of the present invention may also comprise solely a vegetable oil such as corn oil and a citrus solvent such as limonene; however, the cost of the limonene is generally much greater than the ethanol and the limonene is not as effective of a solvent for viscosity control. Higher concentrations of vegetable oil tend to become viscous in cold climate applications, tend to collect dirt, and the oil tends to separate from the solvent at concentrations over 90.0 percent. Addition of a nontoxic solvent such as ethanol provides a low cost means of controlling the viscosity of the formulation. Furthermore, the ethanol solvent provides a self cleaning lubricant. The high percentage of alcohol in the solution provides a solvent means for removing old residue and/or redissolving the old oil residue providing smooth movement of the parts of the instrument even after infrequent use of the instrument.

Furthermore, the combination of a vegetable oil, an alcohol, and a limonene provides a particularly stable lubricant composition having long lasting qualities. Limonene is a widely distributed optically active terpene having a formula of $C_{10}H_{16}$. It occurs naturally in both d and l forms. The racemic mixture of the two isomers is known a dipentene. It is a colorless liquid which oxidizes to form a film in the air, similar to that of rubber or drying oils. It can be derived from citrus fruits such as lemon or orange, as well as bergamot, caraway and other oils such as peppermint and spearmint oils. It is commonly used for flavoring, fragrance, and perfume materials, solvents, wetting agents, and for resin manufacturing. It is also contemplated that limonene dioxide, dipentene dioxide, and limonene monoxide, dipentene monoxide, can be substituted for limonene in the above lubricant compositions.

The composition is manufactured by mixing a selected amount of ethanol in a selected amount of vegetable oil and stirring or shaking the mixture until a homogenous solution is formed therefrom. A selected amount of the citrus "film forming" solvent, preferably limonene, is added to the alcohol and vegetable oil mixture and stirred or shaken until disperse therein. The resultant solution is then applied to the moving parts of an instrument by a syringe or by any other means such as a squeeze bottle, or spray formed by a mechanical pump means or a container containing pressurized gas in combination with the lubricating composition.

The lubricant composition of the present invention may be applied to the internal parts of the instrument and used as a solvent/lubricant to clean old grease and dirt residue from the moving parts. Thereafter, the lubricant composition is applied and distributed in small quantities, a few drops, periodically as needed to insure smooth operation of the instrument. The working life of the lubricating film is about double of that of the film of a conventional vaseline preparation.

Examples of compositions within the scope of the present invention are described herein but it will be understood that neither the accompanying illustrations nor the descriptions thereof are by way of limitation and that other arrangements also within the scope of the present invention will occur to those skilled in the art upon reading the disclosure set forth herein. The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

We claim:

1. A nontoxic, biodegradable lubricating composition comprising from about 0.1 to about 10.0 percent by volume vegetable oil, from about 90.0 to about 99.9 percent by volume of ethanol and from about 0.1 to about 10.0 percent by volume of a citrus solvent.

2. The nontoxic, biodegradable lubricating composition of claim 1, wherein said vegetable oil is selected from the group consisting of corn oil, olive oil, coconut oil, and peanut oil.

3. The nontoxic, biodegradable lubricating composition of claim 1, wherein said citrus solvent is a terpene.

4. The nontoxic, biodegradable lubricating composition of claim 3, wherein said terpene is derived from the group consisting of lemon, lime, orange, and bergamot.

5. The nontoxic, biodegradable lubricating composition of claim 1, wherein said citrus solvent is selected from the group consisting of limonene, limonene dioxide, dipentene dioxide, limonene monoxide, and dipentene monoxide.

6. A method of lubricating a moving part of a musical instrument, comprising the step of applying a nontoxic, biodegradable lubricating composition comprising from about 0.1 to about 10.0 percent by volume vegetable oil, from about 90.0 to about 99.9 percent by volume of ethanol and from about 0.1 to about 10.0 percent by volume of a citrus solvent.

7. The method of lubricating a moving part of a musical instrument as recited in claim 6, wherein said lubricating composition is applied by squeezing said lubricating composition from a syringe.

8. The method of lubricating a moving part of a musical instrument as recited in claim 6, wherein said lubricating composition is applied by squeezing said lubricating composition from a squeeze bottle.

9. The method of lubricating a moving part of a musical instrument as recited in claim 6, wherein said lubricating composition is applied by spraying said lubricating composition from a mechanical pump means.

10. The method of lubricating a moving part of a musical instrument as recited in claim 6, wherein said lubricating composition is applied by spraying said lubricating composition from a container having pressurized gas.

* * * * *